US006840591B2

(12) United States Patent
Wessel

(10) Patent No.: US 6,840,591 B2
(45) Date of Patent: Jan. 11, 2005

(54) METALLIC TOE KICK FOR WOODEN CABINETS

(76) Inventor: David A. Wessel, 1925 E. Country Rd., 1670, Carthage, IL (US) 62321

( * ) Notice: Subject to any disclaimer, the term of this patent is extended or adjusted under 35 U.S.C. 154(b) by 0 days.

(21) Appl. No.: 10/158,989

(22) Filed: May 31, 2002

(65) Prior Publication Data

US 2003/0222552 A1 Dec. 4, 2003

(51) Int. Cl.[7] ..... A47B 81/00
(52) U.S. Cl. ..... 312/278; 312/198; 248/345.1
(58) Field of Search ..... 312/278, 296, 312/198, 140.1, 137, 352; 248/345.1; 52/241, 242, 290

(56) References Cited

U.S. PATENT DOCUMENTS

| | | | | |
|---|---|---|---|---|
| 1,376,203 A | * | 4/1921 | Himes | |
| 2,320,556 A | * | 6/1943 | Belshaw | 312/278 |
| 3,594,056 A | * | 7/1971 | Sager | 312/263 |
| 3,612,634 A | | 10/1971 | Moore, Jr. | |
| 3,628,841 A | | 12/1971 | Sulcek | |
| 3,773,399 A | | 11/1973 | Sulcek | |
| 3,779,624 A | | 12/1973 | Werderitsch | |
| 3,806,090 A | * | 4/1974 | Sasnett et al. | 248/188.2 |
| 4,441,770 A | * | 4/1984 | Brezosky | 312/276 |
| 4,818,043 A | * | 4/1989 | Borgen | 312/296 |
| 5,102,210 A | | 4/1992 | Beals | |
| 5,214,836 A | | 6/1993 | Beals | |
| 5,251,974 A | | 10/1993 | Beals | |
| 5,255,478 A | | 10/1993 | Baranowski et al. | |
| 5,277,487 A | | 1/1994 | Simon | |
| 5,363,617 A | * | 11/1994 | Miller | 248/345.1 |
| 5,456,531 A | | 10/1995 | Beals | |
| 5,647,687 A | | 7/1997 | Robinson et al. | |
| 5,662,399 A | | 9/1997 | Henkel et al. | |
| 5,722,746 A | * | 3/1998 | Hull et al. | 312/140.3 |
| 5,794,903 A | * | 8/1998 | Peterson, II | 248/345.1 |
| 5,951,127 A | * | 9/1999 | Smith | 312/198 |
| 5,992,812 A | * | 11/1999 | Mark | 248/345.1 |
| 6,158,703 A | | 12/2000 | Kessler et al. | |
| 6,364,441 B1 | * | 4/2002 | Arnold | 312/319.1 |

FOREIGN PATENT DOCUMENTS

| | | | |
|---|---|---|---|
| GB | 2066064 | * | 7/1981 |

* cited by examiner

*Primary Examiner*—Lanna Mai
*Assistant Examiner*—Hanh V. Tran
(74) *Attorney, Agent, or Firm*—Leydig, Voit & Mayer, Ltd.

(57) ABSTRACT

In kitchen and bathroom type cabinets made from wooden material, the toe kick located in the toe kick recess at the base of the cabinets is provided with a metallic face. One of the preferred ways to provide this is through two layers of material including a metal plate secured to a wooden support backing material to facilitate mounting to the frame structure of the cabinets. The metallic toe kick may take the form of a kit in which metallic plates are mounted to the preexisting toe kick of kitchen or bathroom cabinets to provide a different aesthetic characteristic to this cabinetry.

6 Claims, 6 Drawing Sheets

METALLIC TOE KICK FOR WOODEN CABINETS

FIELD OF THE INVENTION

The present invention relates generally to wooden cabinets for kitchens, bathrooms or other similar applications, and more particularly relates to the toe kicks and toe kick recesses provided at the base of such wooden cabinets.

BACKGROUND OF THE INVENTION

In wooden cabinets for kitchens and bathrooms, it has long been a design practice to provide a recessed lowermost horizontal portion along the base of the cabinets to allow the front part of a person's feet to extend inwardly beyond the uppermost front surface. In this manner, the person is able to stand closer to the uppermost front surface, hence closer to the front of the countertop. Standing closer to the front of the countertop provides improved ergonomics because the person is required to bend the upper torso section to a lesser degree to perform whatever task is being undertaken. This recessed lowermost front surface is generally referred to as a toe kick or toe kick recess. Wooden cabinets commonly include the toe kick recess along the base of the cabinets at least along the front side and sometimes the lateral ends of the cabinets.

The recessed toe kick surface is typically constructed of a "like" material and has a similar finish as the front or side surface of the cabinet. Most often, the recessed toe kick surface is finished with a wooden material, e.g. wood or wood composite (such as plywood, particle board, etc.) or a colored extruded rubbery-type material, typically in white, black, beige or wood grain. The toe kick surface undergoes far more physical abuse than the uppermost front surface and side surfaces due to the constant contact with the shoes, brooms, mops, vacuum cleaners, etc. The materials used for the front surfaces of the cabinet are selected for this severity and frequency of abuse. The toe kick surface, which is typically constructed of the above materials, will therefore, over time and usage, degrade in appearance as evidenced by scratches, wear, and damage.

Certain types of floor surfaces, notably ceramic tile, provide for the ability to extend the horizontal floor surface upwardly at the intersection of the cabinet base to effectively cover the toe kick surface. While this does provide both protection and aesthetic appeal, it requires that the floor be built around the cabinet structure, which is an extensive and costly undertaking.

There is also an increasing trend toward the use of kitchen appliances that have the appearance of commercial appliances such as are used in restaurants, with the object being to give home kitchens a similar appearance to those of restaurant kitchens. A common material used in commercial appliances is stainless steel. Residential kitchen cabinetry is typically finished in either a natural wood grain, colored rubber or a colored painted surface. In order to coordinate the appearance of cabinetry typically installed in residential kitchens or in new kitchen construction requires the use of costly commercial grade cabinetry.

BRIEF SUMMARY OF THE INVENTION

The present invention is directed toward an improvement in kitchen and bathroom type cabinets comprised of wooden material, in which, the toe kick located in the toe kick recess at the base of the cabinets is provided with a metallic face.

One of the preferred ways to provide this is through two layers of material including a metal plate secured to a support backing material such as wood, wood composite or other appropriate material to facilitate mounting to the frame structure of the cabinets.

According to one aspect of the present invention, an embodiment of the invention may take the form of a kit in which metal plates are provided to cover the face of a pre-existing toe kick or support back board. The kit may be used to provide a different aesthetic characteristic to the existing toe kick. It is an advantage that older preexisting cabinetry may be retrofitted and given a facelift. The metal plate may have an aesthetic appearance matched to that of the existing hardware on the cabinetry.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
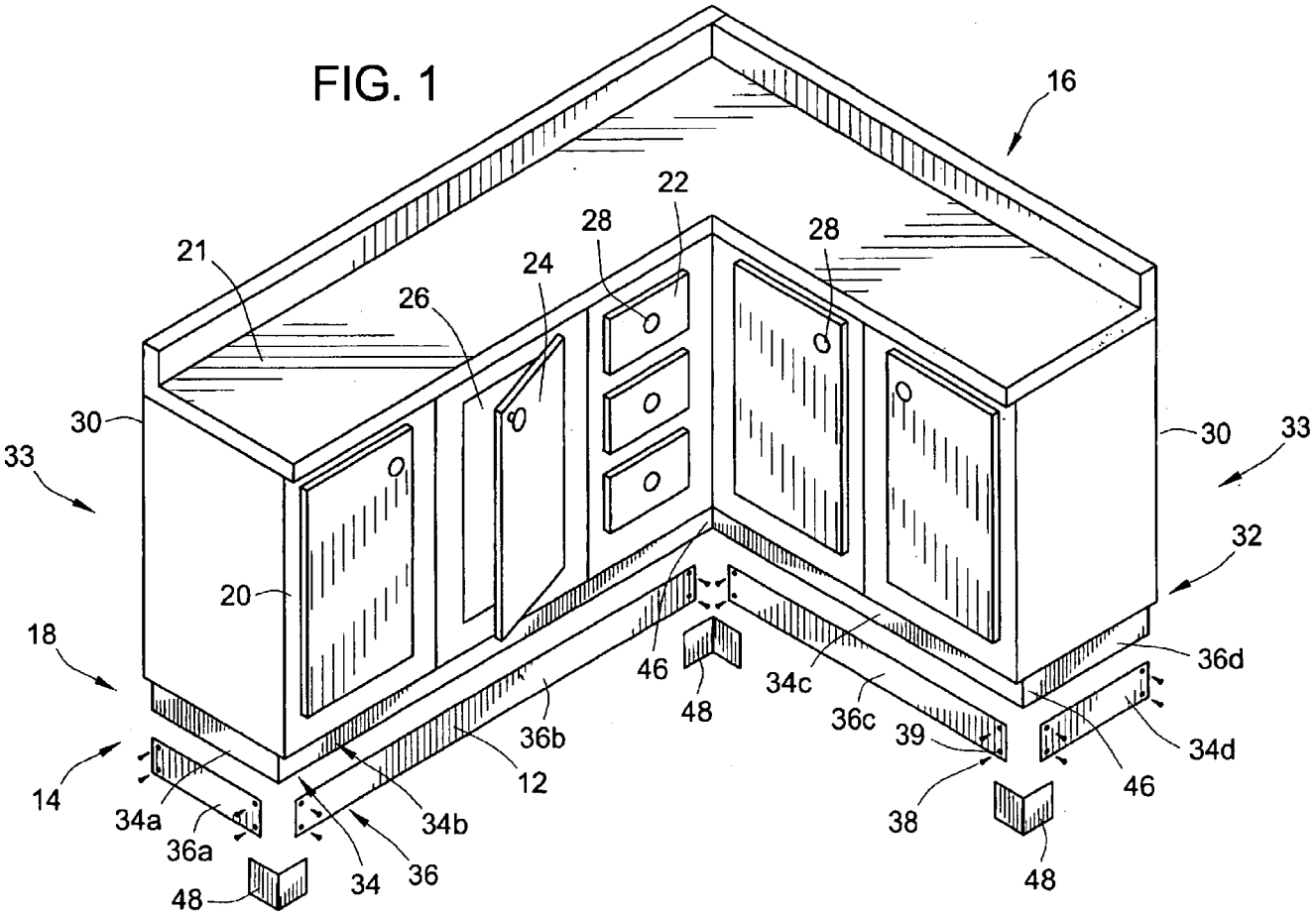
FIG. 1 is an isometric exploded view of a metal plate toe kick kit for installing into the recessed toe kick area of wooden cabinets, according to an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

For purposes of illustration, a preferred embodiment of the present invention is shown as a toe kick kit 10 for providing an exposed metallic face 12 along the toe kick 14 of wooden cabinets 16. The wooden cabinets 16 are often made primarily of wooden materials (such as actual wood or wood laminates or imitation wood products) and are of the type used for kitchens and bathrooms. Kitchen and bathroom type wooden cabinets 16 are most often used in residential applications in bathrooms, kitchens and other similar applications (e.g. laundry rooms, etc.).

There are a wide variety of wooden cabinets 16 available on the market today that are manufactured by different manufacturers. As shown, these wooden cabinets 16 generally include a base 18, a front side 20 that extends upward to a top end such as a countertop 21, and a plurality of drawers 22 and/or doors 24 along the front side 20. The doors 24 provide access to internal storage compartments 26 contained inside the cabinets 16. The doors 24 and drawers 22 are sometimes provided with drawer pulls 28 (e.g. knobs or handles) which are often of metal materials such as brass, chrome, stainless steel, nickel, or other appropriate metal material. The cabinets 16 extend rearwardly to a back side 30 that may mate up against a wall or may be free standing as is the case with a cabinet island.

At the base 18 of the cabinets 16 is a toe kick recess 32 offset rearwardly from the front side 20 (as shown, the toe kick recess 32 may also extend along the base of the cabinets 16 along the front of opposing lateral ends 33 of the cabinets). The toe kick recess 32 allows a person's feet to protrude rearwardly beyond the front side 20 of the cabinets 16. The toe kick recess 32 allows individuals to stand closer to the cabinets 16 in greater comfort. The toe kick recess 32 is defined by the toe kick 14 which is a vertically aligned panel or board generally parallel to the front side 20 or ends 33. The toe kick 14 extends horizontally along the base 18 of the cabinets 16. The toe kick 14 is offset from the front side 20 at a horizontal depth sufficient to accommodate the front most portion of an average foot when a person is standing up close to the cabinets 16.

In accordance with the present invention, the toe kick 14 has a metallic face 12 which provides an entirely different aesthetic characteristic and thereby desirably modifies the overall appearance of the cabinets 16. In a preferred embodiment, the toe kick 14 is comprised of two separate layers of materials including a support backboard 34 and a metal plate 36. The metal plate 36 comprises a metal material of a desired aesthetic characteristic such as brass, chrome, stainless steel, nickel, copper, bronze or other appropriate metal material, and may be matched to the metal finish of the metal hardware (e.g. drawer pulls 28) of the cabinets or the kitchen appliances. The support backboard 34 as shown is typically of wood material (either actual wood or wood composite). In the case of a retrofit kit, the support backboard 34 is the pre-existing toe kick on the cabinets 16. The support backboard 34 may also comprise imitation wood products, plastic, resins, ceramic materials, or other pre-existing toe kick materials.

Figure 5:
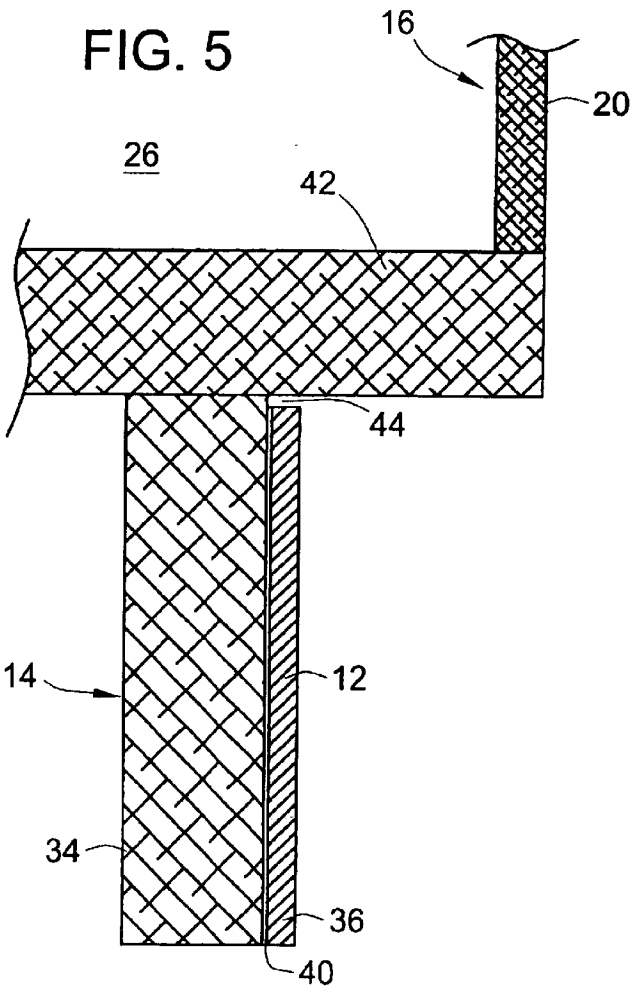
FIGS. 4 and 5 are cross sections of the toe kick area and base section of wooden cabinets with two layer two kicks provided including a wood support backing and a metal face plate, according to two different methods of installation, respectively, according to embodiments of the present invention.
Figure 4:
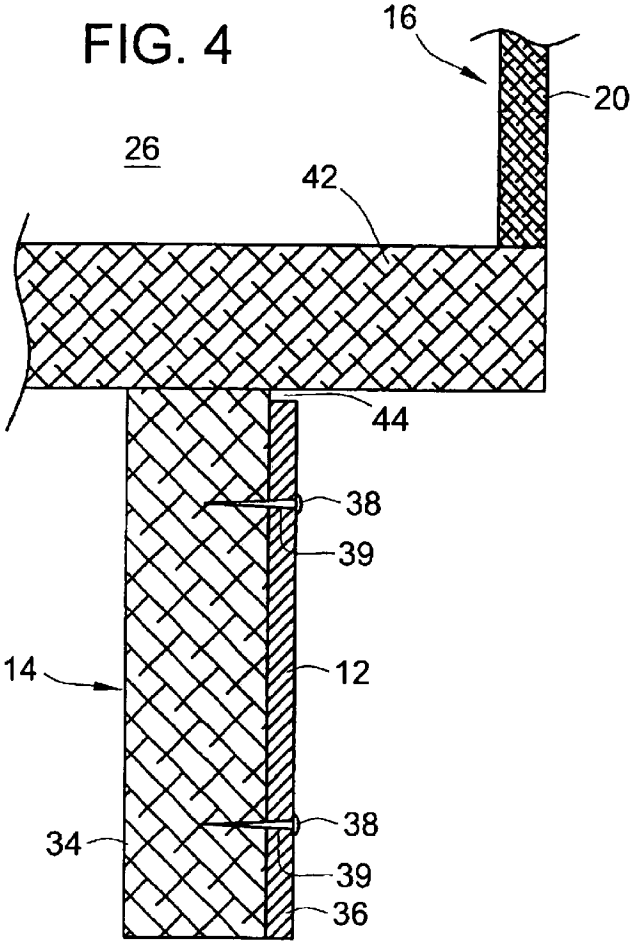

In the preferred embodiment, the metal plate 36 is secured to the support backboard 34 with screws 38 as shown in FIG. 4, or other similar securing means such as nails, rivets or other similar types of fasteners, clamps or mechanical retention devices. The screws 38 mount through formed holes 39 in the metal plate 36. Other securing means may also be used in addition or in the alternative such as an adhesive 40 as shown in FIG. 5, which may take the form of two sided adhesive tape, or glue, caulk, cement, or other similar bonding agents that facilitate mounting of the metal plate 36 to the support backboard 34. In any event, the metal plate 36 covers the support backboard 36 to provide the exposed metallic face 12 along the front of the toe kick 14.

The metal plate 36 has a horizontal length that substantially corresponds to the horizontally length of the toe kick recess 32 at least along the front side 20 in order to cover the front horizontal face of the preexisting toe kick or backboard 34. The metal plate 36 also has a vertical height substantially corresponding to the vertical height of the preexisting toe kick or backboard 34, such that the top of the backboard 34 will not ordinarily be seen when the cabinets are viewed from the room in which the kit 10 is installed. Typically, the vertical height of the metal plate 36 will be slightly less than the vertical height of the preexisting toe kick or backboard 34 (between the top of the floor surface and the bottom horizontal board 42 along the top of the toe kick recess 32). This forms a clearance gap 44 that provides sufficient clearance to allow for easy installation of the metal plate 36 regardless of tolerance ranges, and slight variations in the floor or vertical height of the toe kick recess 32. The clearance gap 44 is also small enough in the vertical dimension such that the top portion of the preexisting toe kick or backboard 34 is not ordinarily visible when a viewed while standing in a room where the cabinets are located. The vertical height of toe kick recesses in kitchen and bathroom cabinets are conventionally between about 3.5 and about 4.5 inches, and therefore, the vertical height of the metal plate 36 may be between about 3.4 and about 4.4 inches for most conventional types of cabinets.

Figure 2:
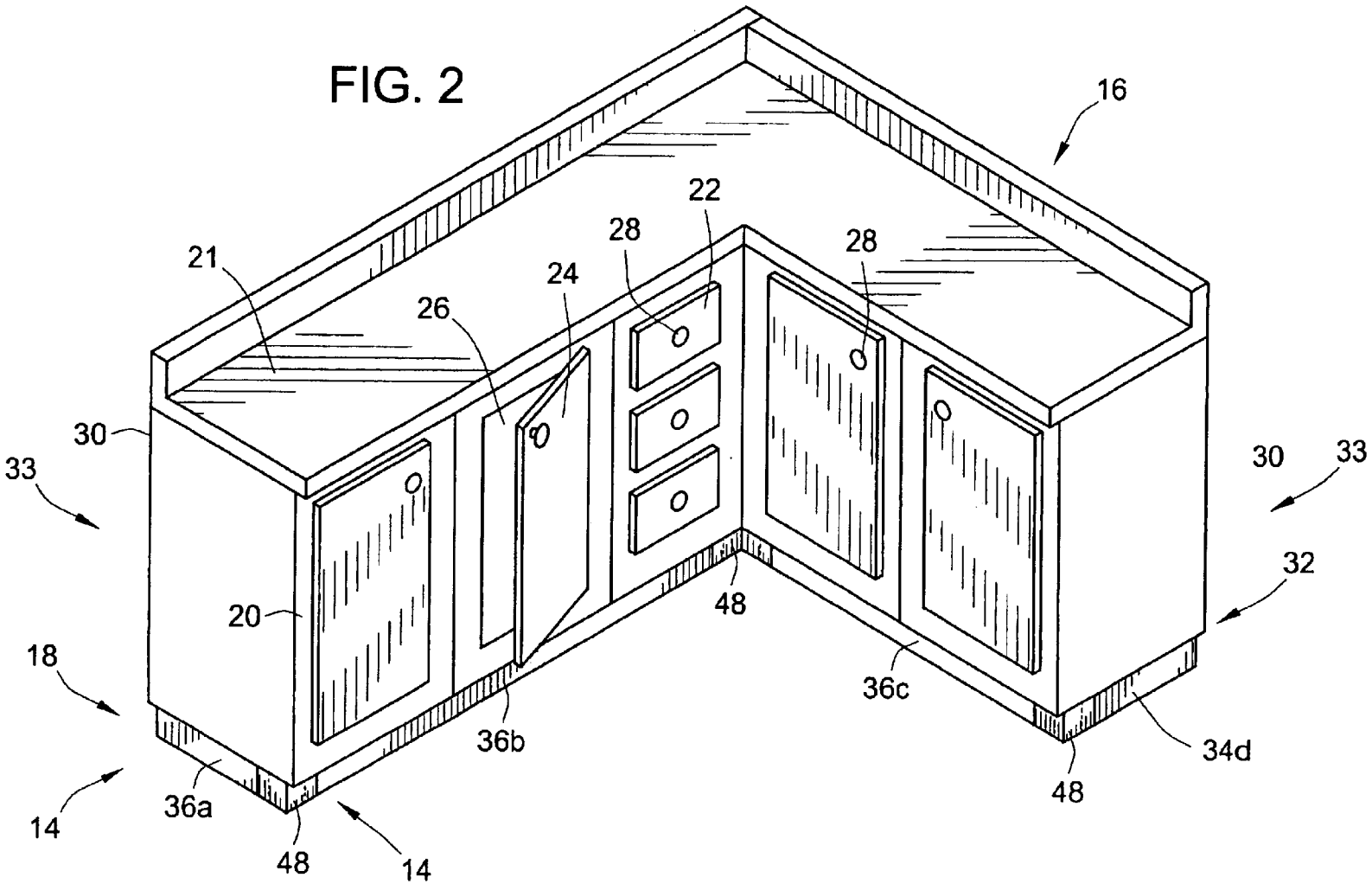
FIG. 2 is an isometric view similar to FIG. 1 but with the kit installed on the cabinets.

In many kitchen and bathroom cabinetry arrangements, sets of cabinets 16*a*, 16*b* are often arranged at different angular orientations such as at perpendicular orientations or along different walls. In these arrangements, there are typically corners 46 (e.g. 90 degrees or 270 degree corners) between adjacent preexisting toe kick or support backboard segments 34*a–d*. Different metal plate segments 36*a–d* are provided in the kit 10 which correspond in horizontal length to each of the support backboard segments 34*a–d*. As shown in FIGS. 1 and 2, different metal plate segments 36*a–d* cover different segments 34*a–d* of the backboard or preexisting toe kick, respectively. The result is a different overall finish and aesthetic appearance to the entire toe kick 14. The metal material in the metal plate segments 36*a–d* also provides an advantage in that it provides a highly durable outer surface that can withstand the constant contact with shoes, brooms, mops, vacuum cleaners, ect.

It is conventional in the cabinet industry that the wooden cabinets for which the kit 10 is intended and their toe kicks are usually provided in multiples of three inch lengths. Therefore, in practicing the present embodiment of the invention on a commercial level, the majority of metal plate segments 36*a–d* can be prefabricated to lengths corresponding to multiples of three inches. In this manner, an inventory of metal plate segments 36*a–d* can be maintained for ready availability to meet the particular needs and cabinet dimensions of a customer. In this manner, the metal plate segments 36*a–d* that make up each individual kit 10 can be picked out of an inventory of different lengths of metal plate segments 36*a–d* of different lengths corresponding to multiples of three inches. This may take the form of a make your own kit at a hardware store where customers pick out selected metal plate segments 36*a–d* of desired lengths to develop a kit, or can be configured by an employee based on measurements provided by a customer, or can be the subject of any other commercially feasible way to get the appropriate lengths of metal plate segments 36*a–d* to customers. To the extent there are special sized metal segments that do not fall into multiples of three inch segments, special sized segments can be specially fabricated or cut from longer segments for the kit 10.

Even though cabinet manufacturers attempt to have cabinet widths that are in multiples of three inches, it will be appreciated that no cabinet is exactly sized but manufactured within an acceptable tolerance range. Further complicating this issue is that the actual sizes of cabinets often vary slightly among different manufacturers. To accommodate such tolerance ranges and size differences between different manufacturers, the metal plate segments 36*a–d* may be slightly shorter than the support backboard segments 34*a–d*. This better ensures that the metal plate segments 36*a–d* will fit in their intended location and that metal cutting operations will not be needed to install the kit 10.

Such undersized metal plate segments 36*a–d* leave the potential for exposed ends at or near the corners 46 of the preexisting toe kick or backboard 34. In circumstances where the metal plate segments 36*a–d* are slightly longer than corresponding backboard segments 34*a–d*, then there is an overhang. To remedy both of these issues, overlapping metal plate corner pieces 48 are used to fit in the toe kick corners 46 to cover up exposed ends or excess end lengths of the metal plate segments. The overlapping metal plate corner pieces 48 have first and second side portions 50 that are connected through an integral hinge 52. The hinge 52 is provided by a coined line area or scored line of weakness that facilitates bending in the corner pieces 48 at the integral hinge 52. Through the adjustment provided in the integral hinge 52, the corner pieces 48 can be molded closely to the contour of the corners 46 existing in the cabinets and the exact angle of corresponding toe kick corners 46 is not critical.

Each side portion 50 of the corner piece 48 may overlap a corresponding end portion 56 of one of the metal plate segments 36*a–d*. By overlapping the corner pieces 48 and the metal plate segments 36*a–d*, any exposed ends at or near the corners 46 of the preexisting toe kick or backboard 34 are eliminated providing a clean sharp finish to the cabinets 16. The corner pieces 48 may also overlap the holes 39 and heads of screws 38 used to mount the metal plate segments 36*a–d* to the preexisting toe kick or support backboard 34. These corner pieces 48 may be made of the same or a similar metal material as the metal plate segments 36*a–d* if a uniform aesthetic appearance is desired.

Figure 3:
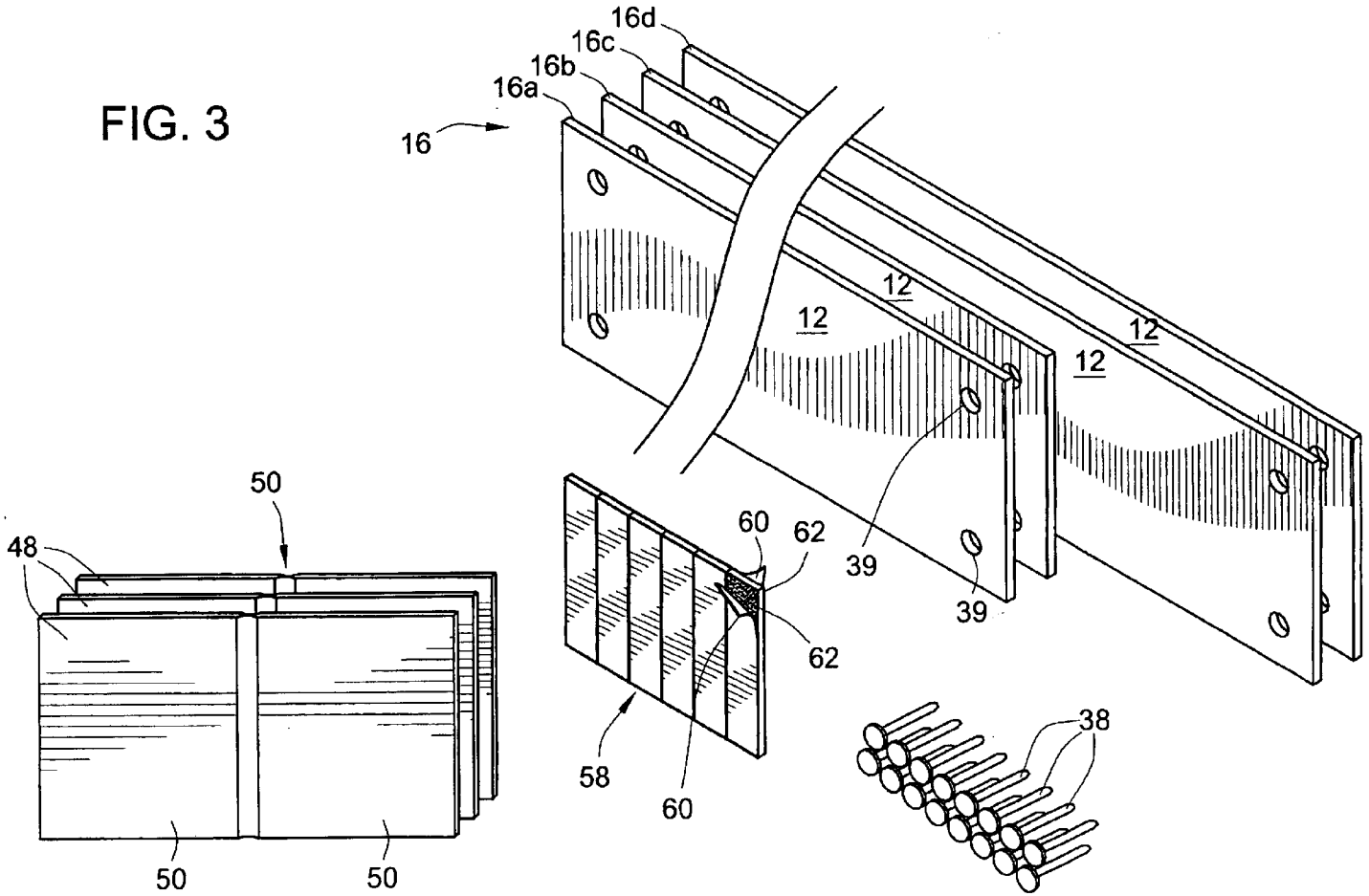
FIG. 3 is an isometric view of a kit including various panel metal plate members and securing devices for securing the metal plate members to the toe kick recess of wooden cabinets, according to an embodiment of the present invention.
Figure 6:
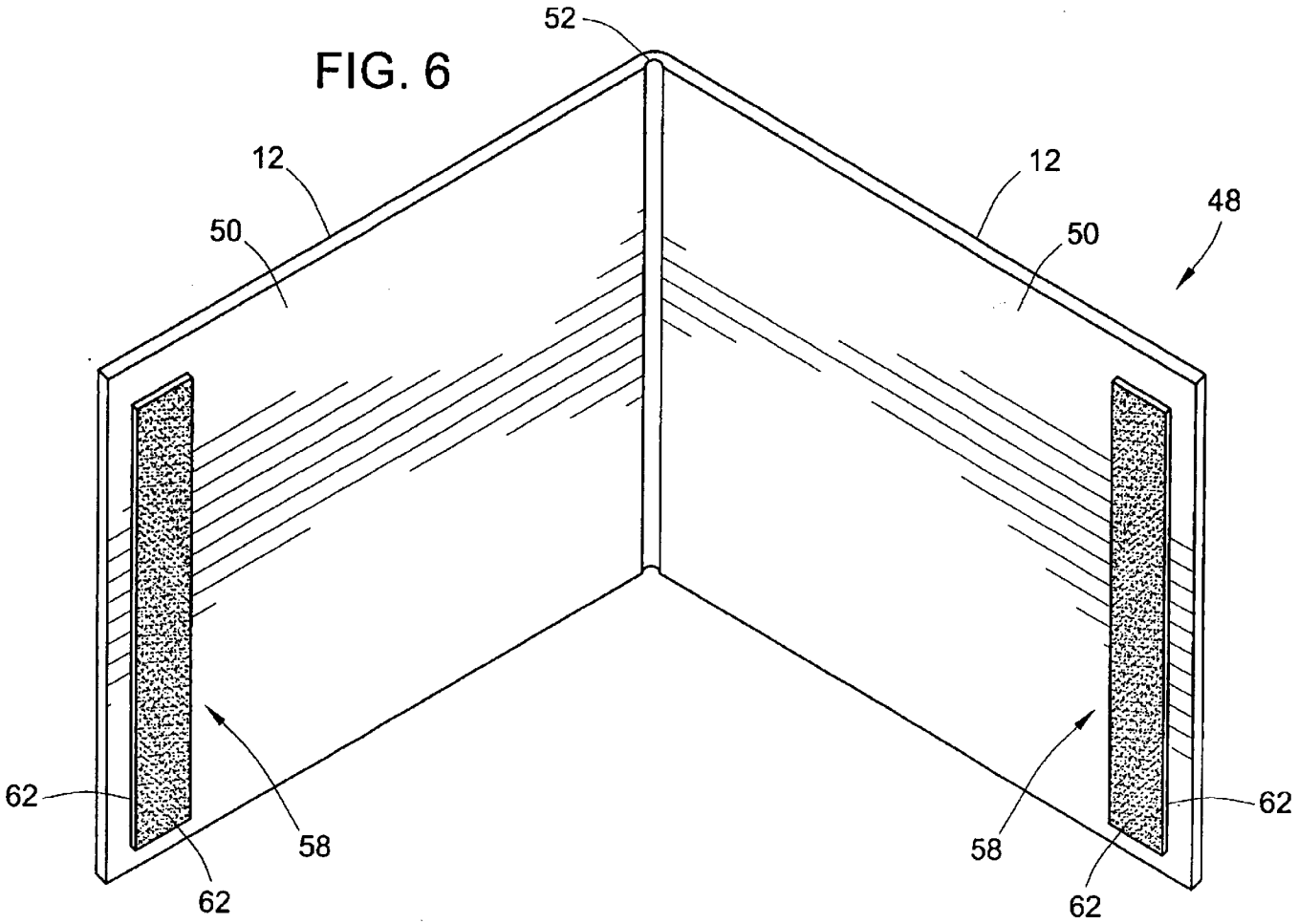
FIG. 6 is an isometric rear side view of a corner member of the kit shown in FIG. 3 with adhesive tabs attached thereto.
Figure 7:
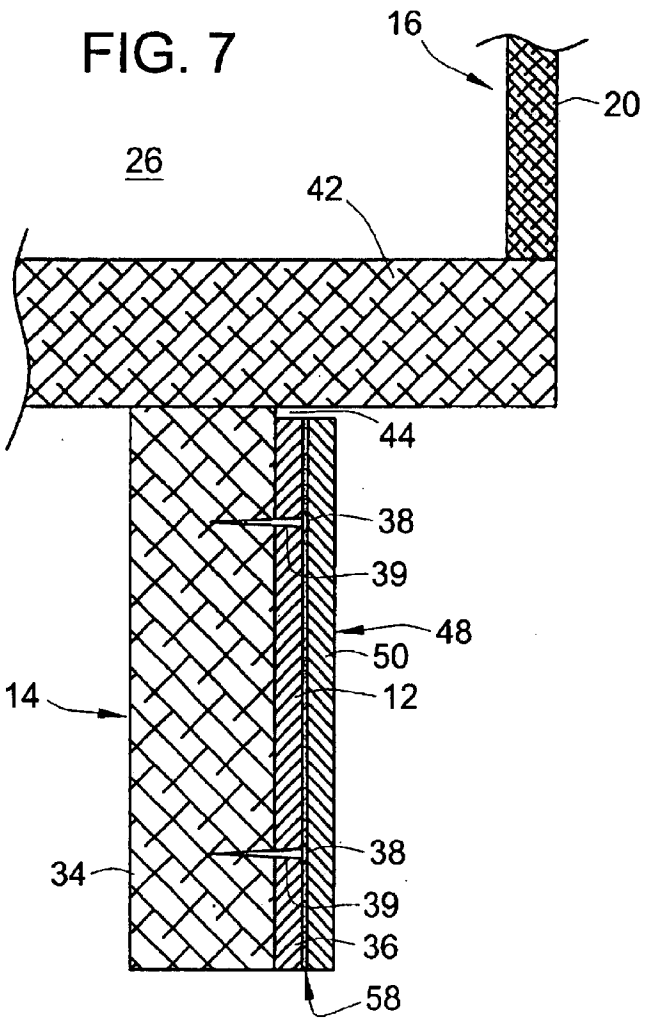
FIG. 7 is a cross section of the toe kick area and base section of wooden cabinets near corner sections of the cabinets, to illustrate the overlap between longitudinal and corner members of an installed toe kick kit according to an embodiment of the present invention.

A preferred way of mounting the metal plate corner pieces 48 is through adhesives such as two sided adhesive tape strips 58 as shown in FIGS. 3 and 6. The adhesive tape strips 58 may have a removable liner 60 on each side that covers and protects the adhesive face 62. Removal of the liner 60 allows for attachment and bonding of the tape strips 58 between the metal plate corner pieces 48 and the metal plate segments 36*a–d* as shown in FIG. 7.

There are a number of different ways to implement the invention. One way described above is through the kit 10 which may be used to retrofit existing cabinets or on new cabinets. With new cabinets, there is then no need to provide a finish on the support backboard 34 as the metal plate 36 will cover it up.

Another way is to provide a metallic face 12 is with a metallic finish on various types of substrate materials such as plastic, resins, or other suitable materials. Such metallic finishes may be integrally formed or bonded to the substrate material through manufacturing processes or be of a separate material such as a sticker with an adhesive backing. This alternative may provide the least expensive implementation of the present invention although it may not provide all of the aesthetic and durability characteristics afforded with real metal plate materials. This alternative may also be used to retrofit existing toe kicks or used in new cabinets.

It should be noted that the metal plate segments 16*a–d* also need not necessarily be straight. The plate segments may be thin or flexible enough to wrap around curved or round portions of cabinet toe kicks.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A kitchen or bathroom type cabinetry, comprising:

a wooden cabinet comprised of wooden material, the wooden cabinet comprising a base, a front side extending upward from the base, and a drawer or door along the front side;

a toe kick recess along the base offset rearwardly relative to the front side;

a toe kick mounted in the toe kick recess, the toe kick comprised of at least two layers including a non-metallic backing and a metallic face, the metallic face being exposed along the front of the cabinet, the non-metallic backing comprising a support panel; and wherein a plurality of cabinets are provided with at least one first cabinet and at least one second cabinet with first and second toe kicks, respectively, the at least one first cabinet arranged perpendicularly relative to the at least one second cabinet such that first and second support panels of the first and second toe kicks extend perpendicularly to each other and intersect at a corner, wherein the metallic face comprises a first metal plate covering the first toe kick and a second metal plate covering the second toe kick, further comprising a corner metal plate covering the corner having a first end overlapping a portion of the first metal plate and a second end overlapping a portion of the second metal plate.

2. The cabinetry of claim 1 further comprising a first adhesive bond securing the first end and the portion of the first metal plate together, and a second adhesive bond securing the second end and the portion of the second metal plate together.

3. A toe kick kit for kitchen or bathroom type cabinets, the cabinets being of wooden material with a front side extending vertically upward from a base, the cabinets having a door or drawer along the front side, the cabinets further having a toe kick along the base offset rearwardly relative to the front side to provide a toe kick recess along the base of the cabinets, the existing toe kick having a horizontal length and a vertical height, the toe kick kit comprising:

at least one metallic toe kick cover having a vertical dimension corresponding substantially to said vertical height and a horizontal dimension sufficient to cover said horizontal length of said toe kick;

means for securing the at least one metallic toe kick cover to the toe kick; and wherein the at least one metallic toe kick cover comprises a plurality of members including longitudinal members and at least one corner member, the at least one corner member adapted to be placed in at least one corner among adjacent ones of the cabinets whereat different portions of the toe kicks extend in different directions, the at least one corner member overlapping edges of two adjacent longitudinal members when mounted to the toe kicks.

4. The toe kick kit of claim 3 wherein at least one corner member comprises a weakened vertical line providing an integral hinge.

5. In kitchen or bathroom type cabinetry comprising a cabinet of wooden material having a front side extending vertically upward from a base, the cabinet having a door or drawer along the front side, the cabinet further having a toe kick along the base offset rearwardly relative to the front side to provide a toe kick recess along the base of the cabinet for providing foot clearance, wherein the improvement comprises: an exposed metallic face on the toe kick;

wherein the toe kick includes a support panel of non-metallic material, and wherein the metallic face is provided by a separate metal plate secured to the support panel; and wherein a plurality of cabinets are provided with at least one first cabinet and at least one second cabinet with first and second toe kicks, respectively, the at least one first cabinet arranged perpendicularly relative to the at least one second cabinet such that the support panels of the first and second toe kicks extend perpendicularly to each other and intersect at a corner, wherein the metal plate comprises a first metal plate covering the first toe kick and a second metal plate covering the second toe kick, further comprising a corner metal plate covering the corner having a first end overlapping a portion of the first metal plate and a second end overlapping a portion of the second metal plate.

6. The cabinetry of claim 5 further comprising a first adhesive bond securing the first end and the portion of the first metal plate together, and a second adhesive bond securing the second end and the portion of the second metal plate together.

* * * * *